United States Patent [19]

Neal

[11] Patent Number: 4,915,320

[45] Date of Patent: Apr. 10, 1990

[54] KITE STRING REEL

[76] Inventor: Terry K. Neal, 2796 Shaw Rd., Compton, Ill. 61318

[21] Appl. No.: 361,269

[22] Filed: Jun. 5, 1989

[51] Int. Cl.[4] ..... B65H 75/40; F41J 9/08

[52] U.S. Cl. ..... 242/96; 242/250; 244/155 A

[58] Field of Search ..... 242/96, 100, 250; 244/155 R, 155 A; 254/362; D8/358

[56] References Cited

U.S. PATENT DOCUMENTS

| | | | |
|---|---|---|---|
| D. 274,832 | 7/1984 | Sugimoto | D8/358 |
| D. 278,359 | 4/1985 | Sugimoto | D8/358 |
| 424,054 | 3/1890 | French | 242/96 |
| 2,190,398 | 2/1940 | Bugatti | 242/250 |
| 3,126,166 | 3/1964 | Weinberg | 242/250 |
| 3,138,356 | 6/1964 | McClain | 242/96 X |
| 3,202,378 | 8/1965 | Williamson | 242/250 |
| 3,593,940 | 7/1971 | Stanton | 242/96 |
| 3,822,839 | 7/1974 | Persichini | 242/96 |
| 4,065,080 | 12/1977 | Alison | 242/96 X |
| 4,168,042 | 9/1979 | Joe et al. | 242/96 |
| 4,448,098 | 5/1984 | Totsu | 81/467 |
| 4,821,976 | 4/1989 | Nakashima | 244/155 A X |

OTHER PUBLICATIONS

Pp. 77 to 79 of the 1989 Kite Catalog of Into The Wind, 1408 Pearl Street, Boulder, Colorado 80302.

*Primary Examiner*—Stuart S. Levy
*Assistant Examiner*—Eric P. Dunlap
*Attorney, Agent, or Firm*—Samuels, Miller, Schroeder, Jackson & Sly

[57] ABSTRACT

A kite string reel, suitable for manual operation and also suitable for power-driven operation by reason of its adaptation for use with a cordless screwdriver having a mouth for accepting interchangeable bits. The kite string reel contains a hollow spool having two flanges. One flange is an annular ring while the other flange is a circular disc. The circular disc has a handle extending away from the spool and a bit extending inward. A removable handle is adapted to fit into the open end of the spool for manual operation or, if power-driven operation is desired, a cordless screwdriver can instead be inserted.

3 Claims, 1 Drawing Sheet

KITE STRING REEL

FIELD OF THE INVENTION

This invention relates to kites and kite accessories. More particularly, this invention relates to kite string reels.

BACKGROUND OF THE INVENTION

The flying of kites is a popular pastime for people of all ages. The kite string is generally stored on some type of spool or stick and is payed out to let the kite fly higher and is wound in to bring the kite back in. Various types of mechanical devices have been used for this purpose. See, for example, the reels, spools, and bobbins featured at pages 77 to 79 of the 1989 Into The Wind Kite Catalog.

Manually winding in a kite string which is out a great distance is a tedious task. Power-driven kite reels have been disclosed to speed up and ease this task. Such reels are disclosed in Williamson, U.S. Pat. 3,202,378, issued Aug. 24, 1965; Stanton, U.S. Pat. 3,593,940, issued Jul. 20, 1971; and Persichini, U.S. Pat. 3,822,839, issued Jul. 9, 1974. Each of these reels contains flashlight-type batteries, an electric motor, and gear means to power a rotating spool. None of the reels has enjoyed commercial success and it is not hard to understand why.

First of all, each of these power-driven reels is relatively complicated mechanically and would, accordingly, be relatively expensive. While money is no object to some kite flyers, the vast majority of kite flyers are children and their parents who fly kites on an infrequent basis and do not want to make a large financial investment in the hobby. Secondly, each of these reels is designed and suited only for power-driven operation. If, for example, the reel malfunctions or the batteries wear out, the reel is virtually useless.

Accordingly, there is a demand for a kite string reel which is inexpensive and can be used either manually or power-driven.

SUMMARY OF THE INVENTION

The general object of this invention is to provide an improved kite string reel. A more particular object is to provide a kite string reel which can be used either manually or power-driven. Another more particular object is to provide such a reel which is inexpensive and which is adapted for use with a cordless screwdriver, a common workshop tool.

I have discovered a kite string reel suitable for manual operation and also suitable for power-driven operation by reason of its adaptation for use with a cordless screwdriver having a mouth for accepting interchangeable bits. The kite string reel comprises: (a) a spool-handle assembly comprising a hollow spool for storing kite string having an inside diameter sufficient to accommodate a cordless screwdriver with flanges on each end, one flange being an annular ring having an inside diameter about the same as the inside diameter of the spool and the other flange being a solid disc with a centrally located handle extending away from the spool on one side and a centrally located bit extending inward on the other, such that a cordless screwdriver can be inserted through the annular flange into the spool where its mouth couples with the bit; and (b) a removable handle containing means for coupling with the spool-handle assembly; such that the removable handle is coupled to the spool for manual operation and a cordless screwdriver having a mouth for accepting interchangeable bits is coupled to the spool for power-driven operation.

This kite string reel can be used manually just as a conventional spool-type kite reel with handles. It can be manufactured for approximately he same cost as a conventional reel, but has the added feature of being power-driven when used with a conventional cordless screwdriver.

DETAILED DESCRIPTION OF THE INVENTION

Figure 1:
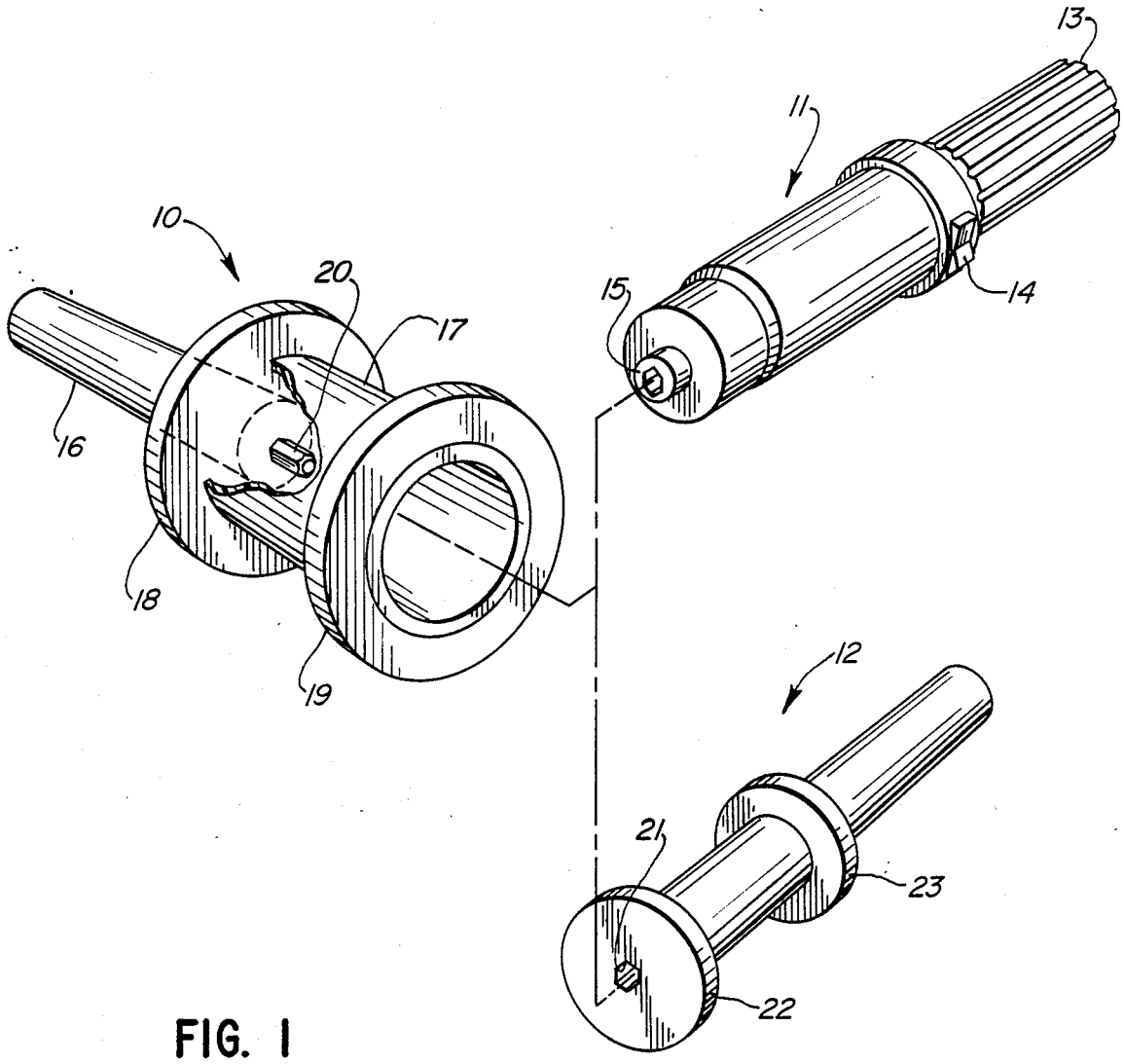
FIG. 1 is a perspective view of the kite string reel of this invention showing the interchangeability of the removable handle and the cordless screwdriver.

This invention is best understood by reference to the drawing. FIG. 1 shows a preferred embodiment of this invention. A spool-handle assembly 10 accepts either a cordless screwdriver 11, for power-driven operation, or a removable handle 12, for manual operation.

The cordless screwdriver is of the type which has become a common workshop tool within the past few years. The screwdriver is generally molded of impact-resistant plastic and has a handle 13, a forward-reverse switch 14, and a hexagonal-shaped mouth 15 at its end for securing interchangeable screwdriver bits. Rechargeable batteries, a motor, and gear means are contained within the screwdriver. The Skil Super Twist TM Cordless Screwdriver, a commercial product of the Skil Corporation, is representative of cordless screwdrivers suitable for use with this invention. This particular cordless screwdriver has a length of about 11 inches, an outside diameter of about $1\frac{3}{4}$ inches, and a weight of about one pound. The mouth turns at approximately 180 RPM in either direction.

The spool-handle assembly 10 consists of a handle 16 and a hollow spool 17 containing flanges 18 and 19. The spool has an inside diameter greater than the outside diameter of the cordless screwdriver to enable the screwdriver to fit inside. This inside diameter is generally about 2 to 3 inches. The spool holds the kite string (not shown) which is tied and then wound around the spool. The flanges help position the string on the spool. The outside diameter of the spool, its length, and the outside diameter of the flanges determine the amount of kite string which can be conveniently stored on the spool. For example, a spool having an outside diameter of about $2\frac{1}{2}$ inches and a length of about $3\frac{1}{2}$ inches with flanges having an outside diameter of about $3\frac{1}{2}$ inches can easily hold 1000 feet of 50 pound braided Dacron kite string.

The flange 18 is a circular disc to which the handle is attached. Centrally mounted to the inside of this flange is a hexagonal bit 20 which couples with the mouth of either the cordless screwdriver or the removable handle. The flange 18 is an annular ring so as to permit either the cordless screwdriver or the removable handle to be inserted into the spool and couple with the hexagonal bit. The spool-handle assembly is made of any suitable material or combination of materials, preferably wood and/or plastic.

Although the vast majority of cordless screwdrivers have the general shape of the model shown in FIG. 1, some units resemble an electric drill in which the handle is at right angles to the bit. To accommodate such a unit, the spool-handle assembly is modified by either replacing the annular flange 19 with a circular disc containing the bit or increasing the diameter and reducing the length of the spool to enable the drill-type screwdriver to fit inside.

The removable handle 12, like the cordless screwdriver, has a hexagonal mouth 21 at its end for coupling with the bit inside the spool. The two flanges 22 and 23 provide a secure fit of the handle within the spool. Other means are also suitable for securing the removable handle to the spool-handle assembly. For example, the addition of splines or a bayonet-type coupler onto flange 23 and a corresponding securing means on the spool-handle assembly permits the elimination of flange 22 and the portion of the removable handle between the flanges. The removable handle can be made of any suitable material, or combination of materials.

The kite string reel of this invention can be used in several different ways. With the removable handle in place, the reel is used manually just as a conventional kite string spool. With the cordless screwdriver in place, but not operating, the reel can also be used manually with the screwdriver functioning only as a handle. With the cordless screwdriver in place and operating, the kite and kite string are unwound or wound using the power of the screwdriver. Finally, and probably preferably, all three components can be used together by having the removable handle in place most of the time and switching to the cordless screwdriver only to wind in the kite and kite string. Because of this versatility, the removable handle need not be considered an essential component of this invention. If the spool-handle assembly is used at all times with a cordless screwdriver in place, the removable handle is superfluous. And even without either a cordless screwdriver or removable handle in place, the spool-handle assembly can be used manually by itself.

One of the major advantages of the kite string reel of this invention is that a large percentage of kite flyers already have a cordless screwdriver so they need only purchase the spool-handle assembly and the removable handle to enjoy all the benefits of the reel. And for those kite flyers who do not already have a cordless screwdriver, the spool-handle assembly and removable handle can be used for manual operation and, if desired, a cordless screwdriver can be acquired later.

I claim:

1. A kite string reel suitable for manual operation and also suitable for power-driven operation by reason of its adaptation for use with a cordless screwdriver having a mouth for accepting interchangeable screwdriver bits, the kite string reel comprising:

(a) a spool-handle assembly comprising a hollow spool with flanges on each end for storing kite string, the spool having an inside diameter sufficient to accommodate a cordless screwdriver, one flange being an annular ring having an inside diameter about the same as the inside diameter of the spool and the other flange being a solid disc with a centrally located handle extending away from the spool on one side of the flange an a centrally located screwdriver bit extending inward on the other side of the flange, such that a cordless screwdriver can be inserted through the annular flange into the spool where its mouth couples with the bit; and (b) a removable handle containing means for coupling with the spool-handle assembly; such that the removable handle is coupled to the spool for manual operation and a cordless screwdriver having a mouth for accepting interchangeable screwdriver bits is coupled to the spool for power-driven operation.

2. The kite string reel of claim 1 wherein the coupling means of the removable handle comprises a plurality of flanges, one of which flanges is located at the end of the handle which is coupled with the spool-handle assembly, and which flange also contains a mouth for coupling with the bit.

3. A kite string reel suitable for manual operation and also suitable for power-driven operation by reason of its adaptation for use with a cordless screwdriver having a mouth for accepting interchangeable screwdriver bits, the kite string reel comprising a hollow spool with flanges on each end for storing kite string, the spool having an inside diameter sufficient to accommodate a cordless screwdriver, one flange being an annular ring having an inside diameter about the same as the inside diameter of the spool and the other flange being a solid disc with a centrally located handle extending away from the spool on one side of the flange and a centrally located screwdriver bit extending inward on the other side of the flange, such that a cordless screwdriver can be inserted through the annular flange into the spool where its mouth couples with the bit for power-driven operation.

* * * * *